US008540587B2

(12) United States Patent
Hirsch et al.

(10) Patent No.: US 8,540,587 B2
(45) **Date of Patent: *Sep. 24, 2013**

(54) GOLF CLUB HEAD WITH SOUND TUNING

(75) Inventors: Robert D Hirsch, Bonsall, CA (US); Joshua G. Breier, Vista, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 332 days.

This patent is subject to a terminal disclaimer.

(21) Appl. No.: 13/073,843

(22) Filed: Mar. 28, 2011

(65) Prior Publication Data

US 2011/0172027 A1 Jul. 14, 2011

Related U.S. Application Data

(63) Continuation of application No. 12/130,266, filed on May 30, 2008, now Pat. No. 7,914,393.

(51) Int. Cl.
*A63B 53/04* (2006.01)

(52) U.S. Cl.
USPC ..... 473/332; 473/346

(58) Field of Classification Search
USPC ..... 473/324–350
See application file for complete search history.

(56) References Cited

U.S. PATENT DOCUMENTS

| | | | |
|---|---|---|---|
| 3,143,349 | A | 8/1964 | MacIntyre |
| 3,847,399 | A | 11/1974 | Raymont |
| 4,545,580 | A | 10/1985 | Tomita et al. |
| 4,602,787 | A | 7/1986 | Sugioka et al. |
| 4,681,322 | A | 7/1987 | Straza et al. |
| 4,928,965 | A | 5/1990 | Yamaguchi et al. |
| 4,928,972 | A | 5/1990 | Nakanishi et al. |
| 4,930,781 | A | 6/1990 | Allen |
| 5,083,778 | A | 1/1992 | Douglass |
| 5,242,168 | A | 9/1993 | Aizawa |
| 5,288,070 | A | 2/1994 | Chen |
| 5,299,807 | A | 4/1994 | Hutin |
| 5,316,298 | A | 5/1994 | Hutin et al. |
| 5,316,305 | A | 5/1994 | McCabe |
| 5,429,365 | A | 7/1995 | McKeighen |
| 5,467,983 | A | 11/1995 | Chen |
| 5,586,947 | A | 12/1996 | Hutin |
| 5,669,827 | A | 9/1997 | Nagamoto |
| 5,718,641 | A | 2/1998 | Lin |
| 5,944,620 | A | 8/1999 | Elmer |
| 6,152,833 | A | 11/2000 | Werner et al. |
| 6,299,547 | B1 | 10/2001 | Kosmatka |
| 6,319,150 | B1 | 11/2001 | Werner et al. |
| 6,368,231 | B1 | 4/2002 | Chen |
| 6,443,854 | B1 | 9/2002 | Calboreanu |
| 6,524,197 | B2 | 2/2003 | Boone |
| 6,699,140 | B1 | 3/2004 | Sun |
| 6,776,725 | B1 | 8/2004 | Miura et al. |
| 6,852,038 | B2 | 2/2005 | Yabu |

(Continued)

FOREIGN PATENT DOCUMENTS

| | | |
|---|---|---|
| JP | 2007-267777 | 10/2007 |

*Primary Examiner* — Alvin Hunter
(74) *Attorney, Agent, or Firm* — Mark S. Leonardo; Brown Rudnick LLP

(57) ABSTRACT

A golf club head with sound tuning. The golf club head includes a hollow body that defines an interior cavity and at least one tuning member extends across the interior cavity. The tuning member dimensions, stiffness and dampening characteristics are selected to alter the vibration behavior of the golf club head.

20 Claims, 10 Drawing Sheets

(56) References Cited

U.S. PATENT DOCUMENTS

| | | | |
|---|---|---|---|
| 6,979,270 | B1 | 12/2005 | Allen |
| 6,991,560 | B2 | 1/2006 | Tseng |
| 7,137,906 | B2 | 11/2006 | Tsunoda et al. |
| 7,156,750 | B2 | 1/2007 | Nishitani et al. |
| 7,163,468 | B2 | 1/2007 | Gibbs et al. |
| 7,247,103 | B2 | 7/2007 | Beach et al. |
| 7,258,624 | B2 | 8/2007 | Kobayashi |
| 7,264,558 | B2 | 9/2007 | Kubica et al. |
| 7,273,420 | B2 | 9/2007 | Wright |
| 7,297,072 | B2 | 11/2007 | Meyer et al. |
| 7,309,296 | B2 | 12/2007 | Souza et al. |
| 7,367,898 | B2 | 5/2008 | Hawkins et al. |
| 7,445,563 | B1 | 11/2008 | Werner |
| 7,445,564 | B2 | 11/2008 | Kusumoto |
| 7,462,110 | B2 | 12/2008 | Yamamoto |
| 7,686,707 | B2 | 3/2010 | Matsunaga et al. |
| 7,749,101 | B2 | 7/2010 | Imamoto et al. |
| 7,775,904 | B2 | 8/2010 | Hirano |
| 7,914,393 | B2 * | 3/2011 | Hirsch et al. ..... 473/332 |
| 2002/0037776 | A1 | 3/2002 | Krumme et al. |
| 2004/0176181 | A1 | 9/2004 | Meyer et al. |
| 2005/0020378 | A1 | 1/2005 | Krumme et al. |
| 2005/0221913 | A1 | 10/2005 | Kusumoto |
| 2006/0068932 | A1 | 3/2006 | Rice et al. |
| 2006/0079349 | A1 | 4/2006 | Rae et al. |
| 2006/0100029 | A1 | 5/2006 | Lo |
| 2006/0258480 | A1 | 11/2006 | Hou et al. |
| 2008/0076595 | A1 | 3/2008 | Lai et al. |
| 2009/0088267 | A1 | 4/2009 | Shimazaki et al. |
| 2009/0258726 | A1 | 10/2009 | Abe |
| 2010/0151964 | A1 | 6/2010 | Soracco |

* cited by examiner

GOLF CLUB HEAD WITH SOUND TUNING

CROSS-REFERENCE TO RELATED APPLICATIONS

This application is a continuation from U.S. patent application Ser. No. 12/130,266, filed May 30, 2008, which is incorporated in its entirety by reference herein.

FIELD OF THE INVENTION

This invention generally relates to golf club heads, and more specifically to hollow golf club heads including sound tuning features.

BACKGROUND OF THE INVENTION

As the size of hollow golf club heads has increased, weight distribution has become a major design consideration. In particular, in the quest to design in discretionary mass, it has become desirable to decrease the wall thicknesses of the portions that do not contribute directly to improved mass properties. Because of the thin wall and the large volumes of the golf club head, large portions of the heads act as membranes and vibrate relative to each other. In some instances, the vibration takes place at a relatively low frequency that results in unappealing sound during impact between the golf club head and a golf ball.

Sound tuning features have been incorporated into hollow bodied golf clubs. One example is described in U.S. Pat. No. 6,852,038 to Yabu for a Golf Club Head and Method of Making the Same. In that example, a hollow body golf club head includes rib-like walls that form the inner surface of the sole and crown. The sound emitted into the hollow cavity due to contact with a golf ball is directed rearward and parted laterally by the ribs. Sound bars are included in some embodiments that are located a small distance behind the club face and extends between the crown and sole. The sound bars are included to further part the sound vibrations.

Another example is described in U.S. Pat. No. 5,718,641 to Lin for a Golf Club Head that Makes a Sound when Striking the Ball. In that example, the golf club head includes a sound plate that is suspended in the hollow body of the club head that makes a sound and echoes the sound during impact between the club head and a golf ball. One edge of the sound plate is fixed to a wall of the hollow club head and the remaining edges are unattached so that the sound plate is able to vibrate relative to the remainder of the club head.

Others have added features to golf club heads to improve rigidity of the club head by reducing relative vibration between opposing walls to reduce the energy that is wasted in deforming the club head and to redirect that energy into the golf ball. For example, U.S. Pat. No. 6,524,197 to Boone for a Golf Club Head Having a Device for Resisting Expansion Between Opposing Walls During Ball Impact describes a feature designed for that purpose. The golf club head includes a tensioning device that extends between the crown and the sole. In particular, the tensioning device includes an elongate cylindrical member that extends through apertures in each of the crown and sole and enlarged ends that are unable to pass through the apertures. One of the enlarged heads is threaded so that a threaded end member may be used to tension the elongate cylindrical member thereby placing the hollow body in compression and increasing the rigidity of the hollow body.

It is desirable to provide a golf club that has sound tuning features for altering the sound produced by the golf club head during ball impact.

SUMMARY OF THE INVENTION

The invention is directed to a golf club head with sound tuning so that the vibration characteristics of the golf club head may be altered to produce a desired sound. Several embodiments of the present invention are described below.

In an embodiment, a golf club head includes a body and a tuning member. The body includes a crown portion and a sole portion and defines an interior cavity. The tuning member extends across the interior cavity and includes a first end that is attached to the crown portion at a first attachment location and a second end that is attached to the sole portion at a second attachment location. The body includes a first distance between the first attachment location and the second attachment location when the body is in a free state, and the tuning member has a length that is greater than the first distance when the tuning member is in a free state.

In another embodiment, a golf club head includes a body and a curved tuning member.

The body includes a crown portion, a sole portion, a toe portion extending between the crown portion and the sole portion and a heel portion extending between the crown portion and the sole portion and defines an interior cavity. The curved tuning member extends across the interior cavity and a first end of the tuning member is attached to the crown portion at a first attachment location and a second end of the tuning member is attached to the sole portion at a second attachment location. The tuning member is oriented so that it is curved away from the nearest of the toe portion and the heel portion. In a further embodiment, a golf club head includes a body, a cover and a tuning member. The body includes a crown portion and a sole portion and defines an interior cavity. An aperture extends through the sole portion. The cover is removably coupled to the sole portion in the aperture. The tuning member extends across the interior cavity and a first end of the tuning member is attached to the crown portion at a first attachment location and a second end of the tuning member is attached to the cover.

BRIEF DESCRIPTION OF THE DRAWINGS

In the accompanying drawings, which form a part of the specification and are to be read in conjunction therewith and in which like reference numerals are used to indicate like parts in the various views.

DETAILED DESCRIPTION OF THE PREFERRED EMBODIMENT

The present invention is directed to a golf club head including sound tuning features. The sound tuning features are included to tailor the sound produced by the golf club head to any desired frequency, amplitude and/or duration. Several embodiments of the present invention are described below.

Every golf club produces a distinct sound and feel when it is used to strike a golf ball. The sound and feel are produced by the vibration behavior of the golf club head which is a result of the design of the golf club head. Golf club head designs are analyzed and samples are tested to characterize the vibration characteristics of a particular design in an attempt to determine whether the sound and feel produced by the golf club head will be acceptable to the average golfer. In particular, the frequency values and displacement mode shapes are determined for the club head. It is generally understood that the lower frequency modes have a tendency to detrimentally affect the sound and feel of a particular golf club head.

Figure 1:
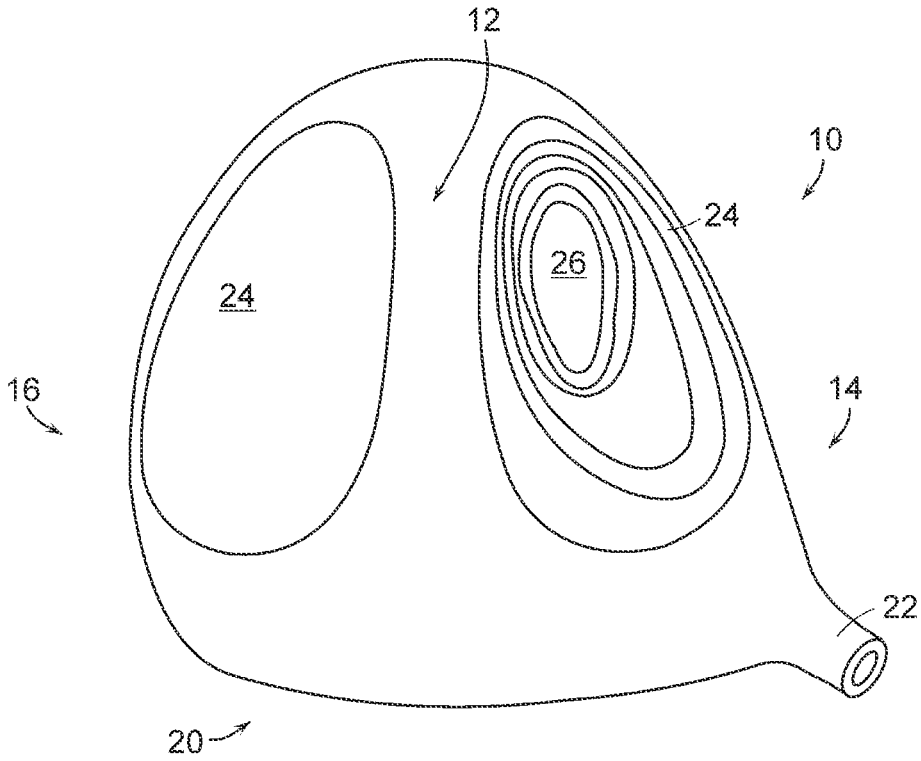
FIG. 1 is a top view of a conventional golf club head schematically illustrating the displacement of an exemplary first vibration mode.
Figure 2:
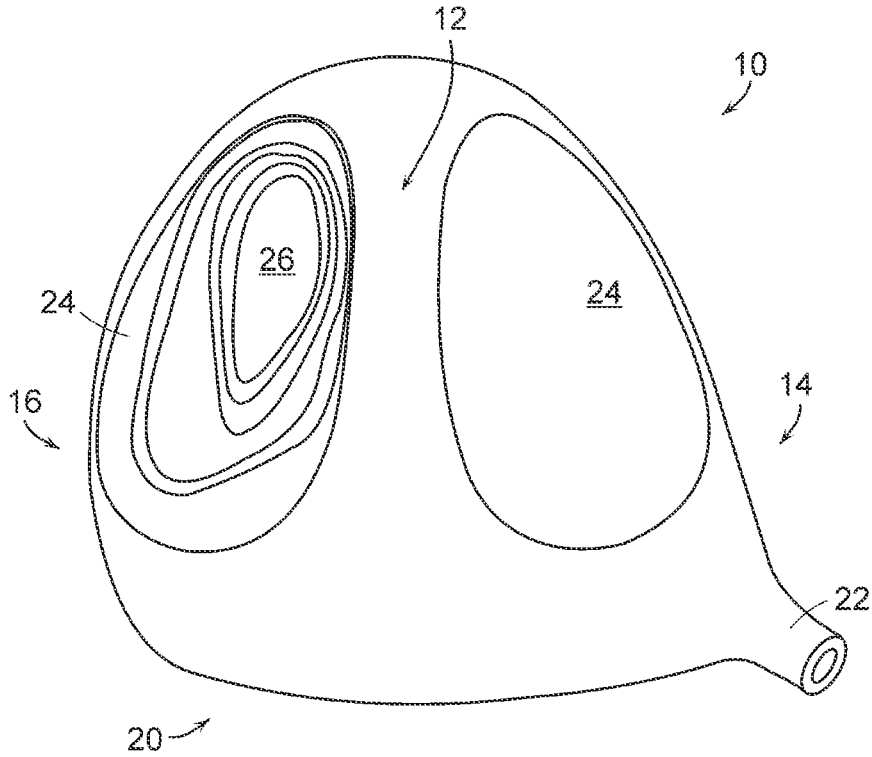
FIG. 2 is a top view of the golf club head of FIG. 1 schematically illustrating the displacement of an exemplary second vibration mode.

Referring to FIGS. 1 and 2, the first two vibration mode shapes of a first exemplary hollow golf club head 10 are shown. Golf club head 10 generally includes a crown portion 12, a heel portion 14, a toe portion 16, a rear portion 18, a front portion 20, a hosel 22 and a sole portion (not shown) that combine to form a generally hollow body having an interior cavity. Front portion 20 includes a striking face for impacting a golf ball. Crown portion 12 extends rearward from front portion 20 and forms a top surface of club head 10. Heel portion 14 and toe portion 16 form sidewalls of club head 10 and extend generally downward from the edges of crown portion 12 and rearward from side edges of front portion 20. Rear portion 18 extends between heel portion 14 and toe portion 16 to complete the side wall of club head 10. The sole portion extends between the lower edges of front portion 20, heel portion 14, toe portion 16 and rear portion 18 and generally forms the bottom surface of club head 10.

Crown portion 20 of golf club head 10 includes a pair of concave dimples 24 that are spaced from each other in a heel-to-toe direction. In a first vibration mode, i.e., the vibration mode having the lowest frequency value, a location of maximum displacement 26, or "hot spot", is located at dimple 24 that is closest to heel portion 14, as shown in FIG. 1. In a second vibration mode, i.e., the vibration mode having the second lowest frequency value, the location of maximum displacement 26 is located on dimple 24 that is closest to toe portion 16.

Figure 3:
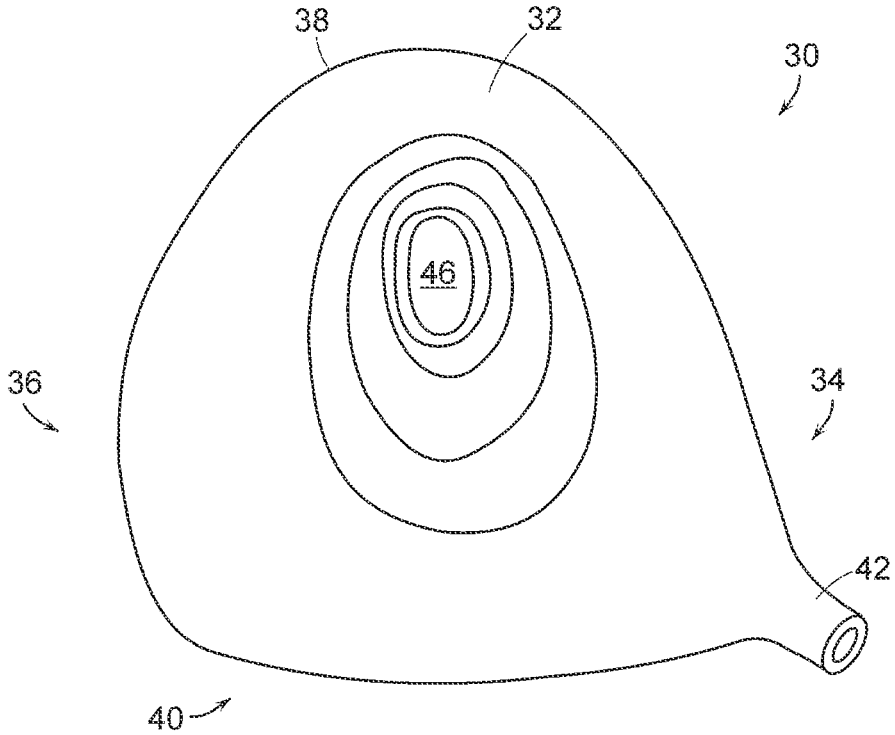
FIG. 3 is a top view of another conventional golf club head schematically illustrating the displacement of an exemplary first vibration mode.

Referring to FIG. 3, the first vibration mode shape of a second exemplary hollow club head 30 is shown. Similar to the previously described golf club head, the second exemplary hollow golf club head 30 includes a crown portion 32, a heel portion 34, a toe portion 36, a rear portion 38, a front portion 40 and a hosel 42. Crown portion 32 of golf club head 30 is a continuous convex surface that includes no dimples. The first vibration mode of golf club head 30 provides a location of maximum displacement 46, or hot spot, that is located generally centrally on crown portion 32.

In each of the illustrated embodiments, the lowest frequency modes involve vibration of at least portions of the crown. The exemplary clubs may also exhibit vibration modes wherein at least a portion of the sole vibrates. However, at least in the exemplary golf club heads, the lowest frequency modes either do not include simultaneous vibration of the sole or the sole vibration is out of phase with that of the crown or has a lower displacement amplitude. It should be appreciated that in some golf club heads the lowest frequency mode may include a location of maximum displacement that is located on the sole of the club head and the present invention applies equally to those golf club heads.

Figure 4:
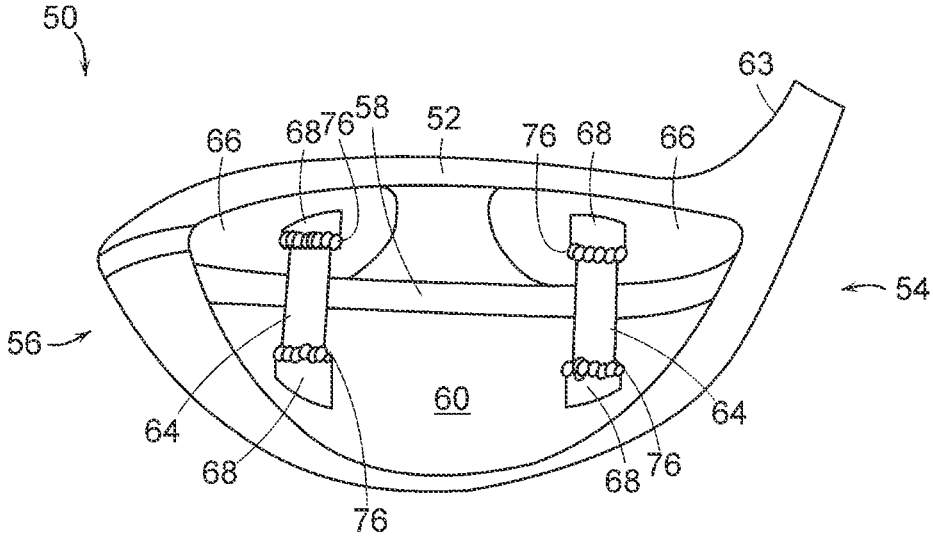
FIG. 4 is a front view of an embodiment of a golf club head in accordance with the present invention.
Figure 5:
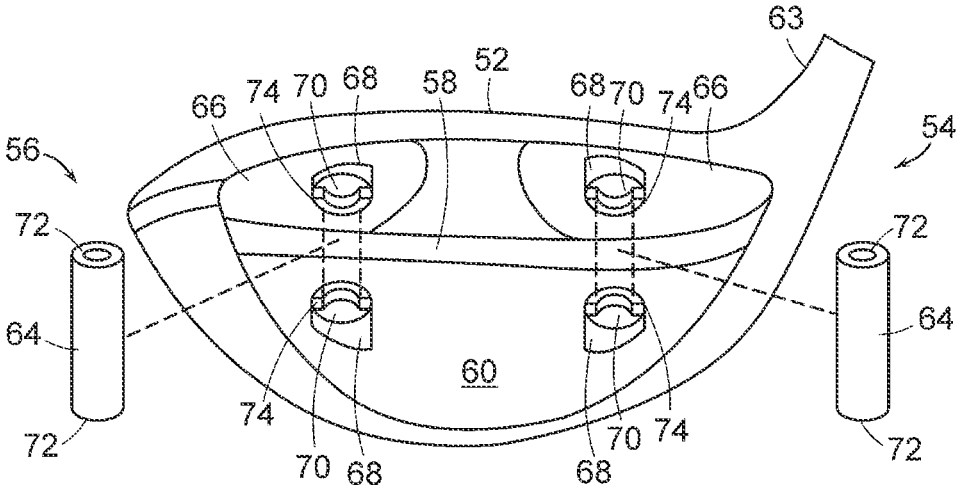
FIG. 5 is a partially exploded view of the golf club head of FIG. 4.
Figure 6:
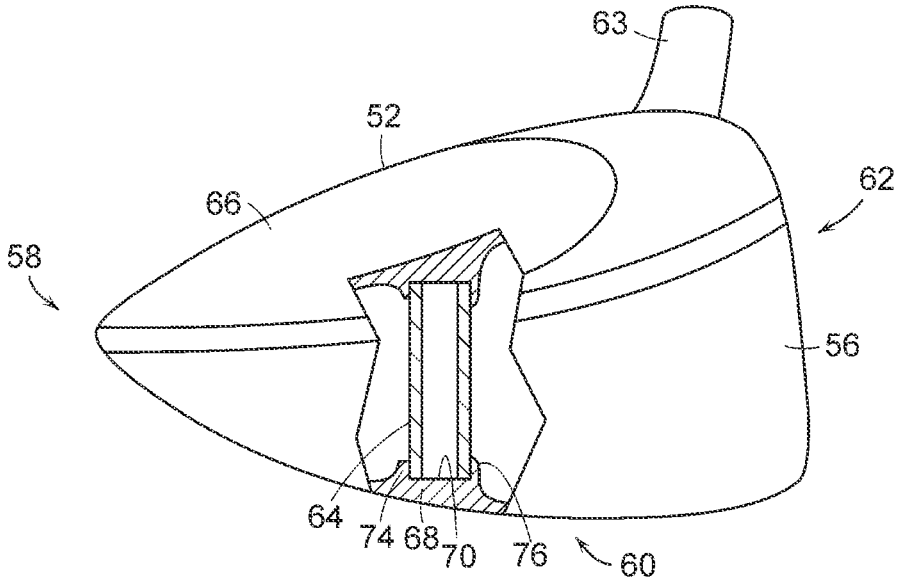
FIG. 6 is a partial cross-sectional view of the golf club head of FIG. 4.

Referring to FIGS. 4-6, an embodiment of a golf club head in accordance with the present invention, golf club head 50, will be described. Golf club head 50 generally includes a crown portion 52, a heel portion 54, a toe portion 56, a rear portion 58, a sole portion 60, a front portion 62, a hosel 63 and a pair of tuning members 64.

Crown portion 52 and sole portion 60 form the upper and lower surfaces, respectively, of golf club head 50. Additionally, crown portion 52 and sole portion 60 generally provide the majority of the surface area of club head 50. In order to maintain the large volume of modern golf club heads while providing the maximum discretionary mass, crown portion 52 and sole portion 60 tend to have relatively thin walls, which results in the those portions often acting as a vibrating membrane during and after impact with a golf ball.

Crown portion 52 and sole portion 60 are spaced from each other by heel portion 54, toe portion 56, rear portion 58 and front portion 62 so that the combined portions define a hollow interior cavity. In the present embodiment, tuning members 64 are tubular components that extend across the hollow interior cavity and each tuning member includes a first end attached to the crown at a first attachment location and a second end attached to the sole at a second attachment location. A pair of tuning members 64 is provided to alter the first two vibration modes of golf club head 50 which exhibit locations of maximum displacement in each of dimples 66 so the attachment locations on the crown are disposed adjacent the locations of maximum displacement.

Bosses 68 are included on crown portion 52 and sole portion 60 at the respective attachment locations and provide attachment features for coupling tuning members 64 to crown portion 52 and sole portion 60. Bosses 68 are raised portions that extend inward from the inner surfaces of each of crown portion 52 and sole portion 60. Each boss 68 includes a mating surface 70 that is configured to abut an end surface 72 of tuning member 64. Mating surface 70 is contoured to match the contour of end surface 72 of tuning member 64. For example, mating surface 70 may be planar so that it abuts a planar end surface 72 of tuning member 64, as shown, or the mating surface may be curved or angular to abut a curved or angular end surface of the tuning member.

Additionally, each boss 68 includes a locating member 74 that aligns the end of tuning member 64 on boss 68 so that tuning member 64 is properly located for attachment. In the present embodiment, locating member 74 is an arcuate wall that extends from mating surface 70 toward the center of the hollow interior cavity. The curvature of locating member 74 is selected so that it abuts a portion of the outer surface of tuning member 64. Locating member 74 is utilized during the attachment of tuning members 64 so that tuning members 64 remain properly located during the attachment process. The attachment process may include welding, brazing, bonding and/or applying fasteners. In the present embodiment, tuning members 64 are attached to bosses 68 by attachments 76.

Bosses 68 may be integrated into golf club head 50 using any process. Preferably, bosses 68 are cast integral with crown portion 52 and sole portion 60 and constructed with the same material as crown portion 52 and sole portion 60. For example, crown portion 52, sole portion 60 and bosses 68 are preferably cast from titanium or a titanium alloy, however, they may be formed from any metallic material or combinations of metallic and non-metallic materials. Alternatively, the crown portion, the sole portion and/or the bosses may be constructed as separate components using various methods and coupled together. For example, the parts may be constructed by casting, stamping and/or forging and subsequently coupled by any attachment method such as, for example, welding and/or adhesive bonding.

The stiffness and damping characteristics of the tuning members are selected so that the vibration modes are altered to improve the sound of the golf club head at impact. Tuning members 64 may be constructed from any material and may have any cross-sectional shape. For example, in the present embodiment, tuning members 64 are tubular, but it should be appreciated that the tuning members may be solid. Additionally, the tuning members may be constructed from metallic materials, such as titanium, aluminum and/or steel, or non-metallic materials, such as carbon fiber and/or polymer. Additionally, the tuning members may have composite structures.

The tuning members are also sized to provide desired vibration behavior. Preferably, tuning members 64 are sized so that they are placed in compression between mating surfaces of bosses 68. For example, tuning members 64 may be constructed having a length in a free state that is greater than the distance between mating surfaces 70 of bosses 68, which serve as attachment locations of the tuning members 64, when the golf club head is in a free state. The free state for the tuning members and the golf club head corresponds to the state when no external forces are applied to the respective component.

Figure 7:
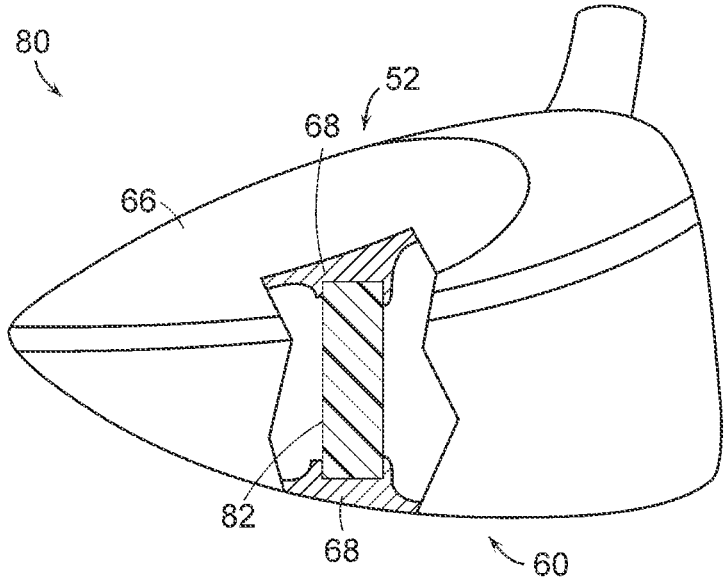
FIG. 7 is a partial cross-sectional view of another embodiment of the golf club head in accordance with the present invention.

Referring to FIG. 7, another embodiment of a golf club head in accordance with the present invention will be described. Golf club head 80 includes tuning members 82 that extend between crown portion 52 and sole portion 60. The components that are substantially identical to those previously described are denoted by identical reference numbers and will not be described in further detail. Golf club head 80 includes bosses 68 located on crown portion 52 and sole portion 60 that are configured to receive tuning members 82. Tuning member 82 are cylindrical rods that extend between bosses 68. In the present embodiment, tuning members 82 are constructed of a polymer material that is bonded in golf club head 80 between bosses 68.

Figure 8:
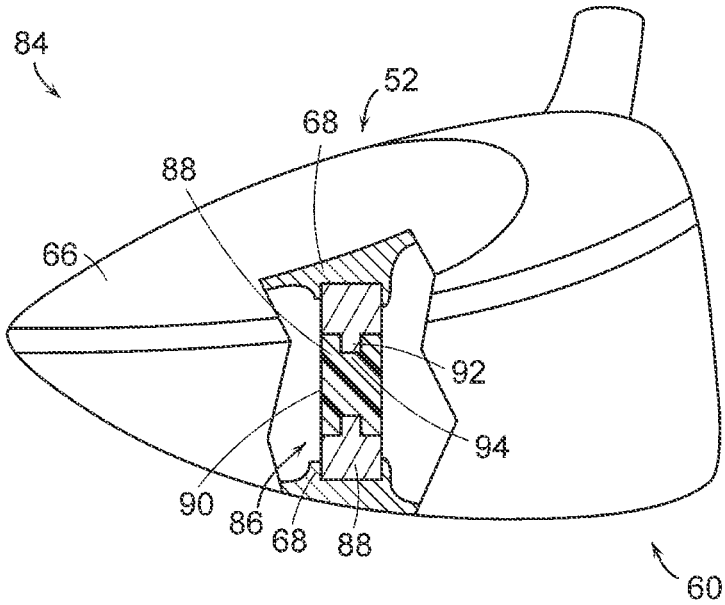
FIG. 8 is a partial cross-sectional view of another embodiment of the golf club head in accordance with the present invention.

In another embodiment, shown in FIG. 8, golf club head 84 includes composite tuning members 86. Tuning members 86 extend between crown portion 52 and sole portion 60. Tuning members 86 include a three piece composite construction that includes spacer 90 interposed between caps 88. In the present embodiment, caps 88 are constructed from metallic material and spacer 90 is constructed from a non-metallic material that is bonded to caps 88. Tuning members 86 are inserted between bosses 68 and caps 88 are attached to bosses. Because caps 88 are constructed of metallic material, tuning members 86 may be attached to metallic bosses 68 by welding or brazing. Caps 88 and spacer 90 may also include complementary coupling features. For example, caps 88 may include posts 92 that are received in bores 94 included in spacer 90. It should be appreciated that spacer 90 may be constructed from a material having dampening properties, such as a viscoelastic polymer, if desired.

Figure 9:
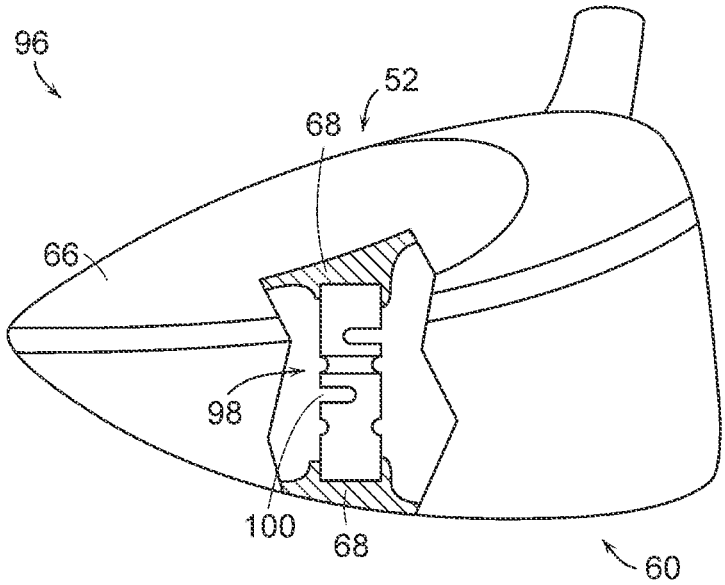
FIG. 9 is a partial cross-sectional view of another embodiment of the golf club head in accordance with the present invention.

The tuning member may also include stiffness altering features. Referring to FIG. 9, golf club head 96 includes tuning members 98 that extend between crown portion 52 and sole portion 60. Tuning members 98 include a plurality of stiffness altering features in the form of lateral slots 99 that reduce the stiffness of tuning members 98 to a desired stiffness. It should be appreciated that any features that change the stiffness of the tuning member may be included, such as, for example, lateral slots (as shown), bores or notches extending into the tuning member, and/or changes in cross-sectional shape and/or area.

Figure 10:
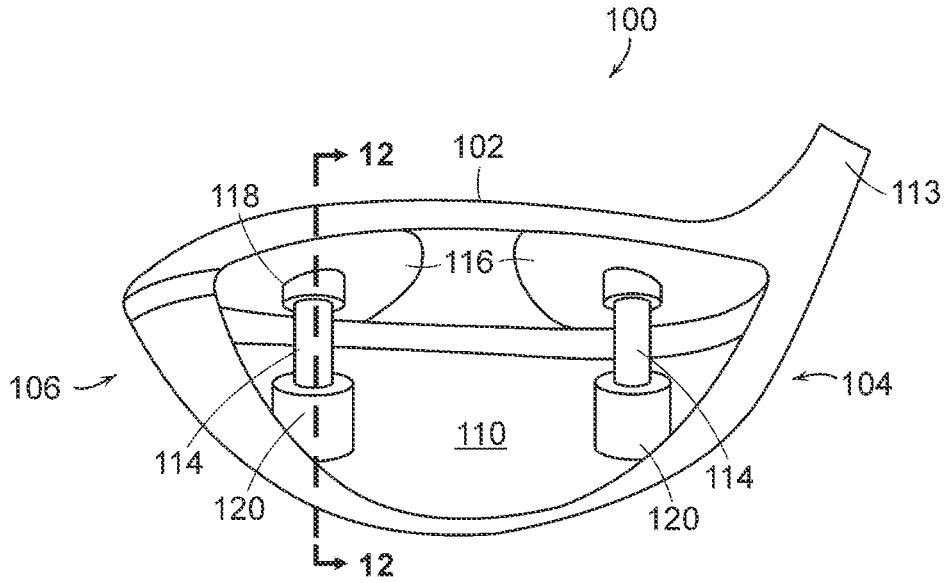
FIG. 10 is a front view of another embodiment of a golf club head in accordance with the present invention.
Figure 11:
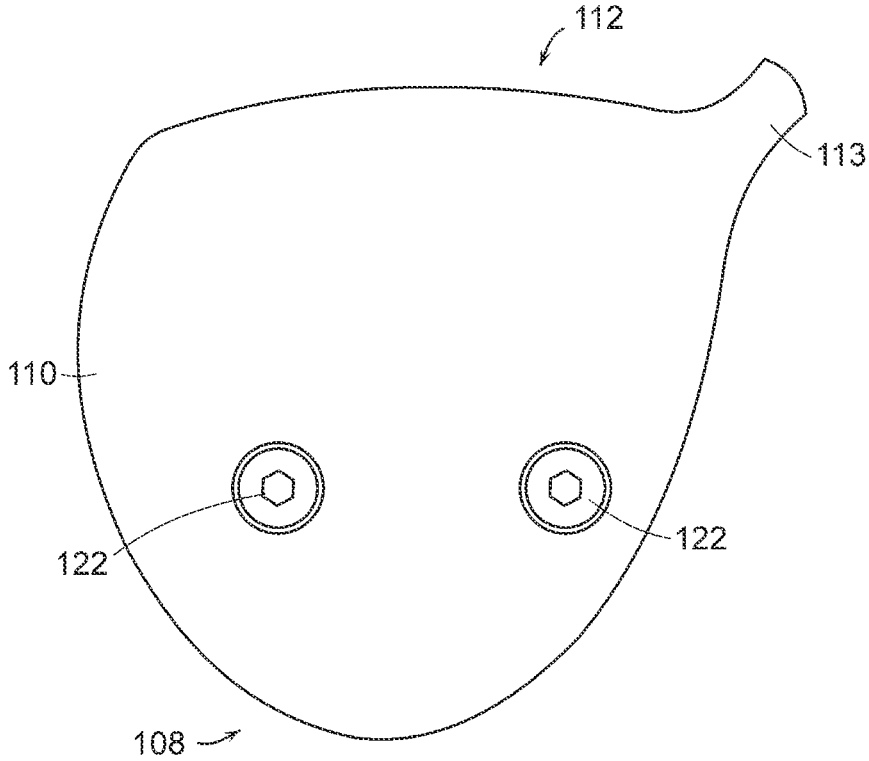
FIG. 11 is a bottom view of the golf club head of FIG. 10.

Referring to FIGS. 10-11, another embodiment of a golf club includes removable tuning members. Similar to the previously described embodiments, a crown portion 102 including dimples 116, a heel portion 104, a toe portion 106, a rear portion 108, a sole portion 110, a front portion 112 and a hosel 113 combine to form the hollow body of golf club head 100. Tuning members 114 extend across the interior hollow cavity between crown portion 102 and sole portion 110 and are selected to create desired vibration characteristics of golf club head 100.

Tuning members 114 extend between mounting features of crown portion 102 and mounting features of sole portion 110. The mounting features of crown portion 102 include bosses 118 extending inward from an inner surface of crown portion 102. The mounting features of sole portion 110 include bosses 120 and covers 122. Covers 122 are configured to be removably coupled to apertures that extend through sole portion 110 and bosses 120. For example, bosses 120 include a threaded internal surface that engages threaded outer surfaces of covers 122. Each cover 122 includes a tool engagement feature 132 so that cover may be installed and removed by a user. It should be appreciated that cover 122 may be attached to boss 120 using any permanent, semi-permanent or removable attachment method. For example, cover 122 may be bonded into boss 120, or cover 122 may be threaded into boss 120 and a thread locking feature or material included. It should be appreciated that tuning members 114 may have any configuration, such as the various embodiments described herein, and a user may select a configuration for each position to tailor the sound to any desired characteristics.

A first end 124 of each tuning member 114 is inserted into a bore 126 included in boss 118. Cover 122 is then installed in boss 120 so that a second end 128 is inserted into a bore 130 included in cover 122. When cover 122 is installed in boss 120, tuning member 114 is held in compression between boss 118 and cover 122.

In another embodiment, the tuning members include a spring and dampening components. Referring to FIGS. 13-17, an embodiment including separate spring and dampening components will be described. Golf club head 140 includes a crown portion 142 that includes dimples 154, a heel portion 144, a toe portion 146, a rear portion 148, a sole portion 150 that combine to form the hollow body of club head 140. Golf club head 140 also includes a tuning member 152 that extends across the hollow interior of the club head between crown portion 142 and sole portion 150.

Tuning member 152 is constructed from a spring component 156 and a dampening component 158. Spring component 156 is generally an elongate plate member that includes a spring portion 160 that is interposed between a pair of mounting portions 162. Spring portion 160 includes a plurality of stiffness altering features 164 that include a plurality of notches extending laterally through a portion of spring component 156 so that spring portion 160 is generally S-shaped and has a reduced stiffness in comparison to mounting portions 162.

Dampening component 158 includes a dampening member 168 interposed between a pair of frame members 166. Frame members 166 are elongate plates that provide mounting surfaces so that dampening member 168 may be mounted to and between frame members 166. In the present embodiment, dampening member 168 is a viscoelastic polymer.

Figure 18:
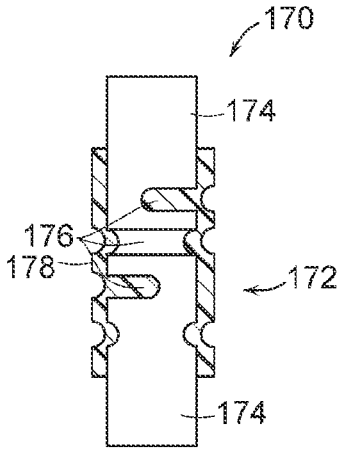
FIG. 18 is a partial cross-sectional view of an embodiment of a tuning member that may be included in a golf club head in accordance with the present invention.

Referring to FIG. 18, another embodiment of a tuning member 170 will be described. Tuning member 170 includes a spring member 172 that is interposed between a pair of mounting portions 174. Spring member 172 includes a plurality of stiffness altering features in the form of lateral slots 176 that reduce the stiffness of tuning member 170 to a desired stiffness. Tuning member 170 also includes a dampening member 178 that encases at least a portion of spring member 172 and extends into lateral slots 176. Dampening member 178 may be any material having vibration dampening characteristics such as a viscoelastic polymer.

Figure 19:
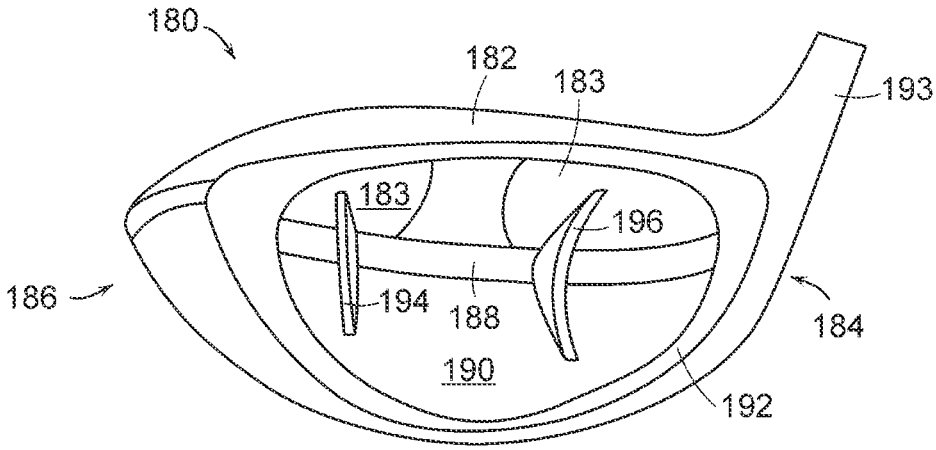
FIG. 19 is a front view of another embodiment of a golf club head in accordance with the present invention.

Another embodiment of a golf club head including tuning members is illustrated in FIG. 19. Golf club head 180 is a hollow body constructed from a crown portion 182 including dimples 183, a heel portion 184, a toe portion 186, a rear portion 188, a sole portion 190, a front portion 192 and a hosel 193. Tuning members 194, 196 extend across the interior hollow cavity between crown portion 182 and sole portion 190 and are selected to create desired vibration characteristics of golf club head 180.

Golf club head 180 includes a planar tuning member 194 and a curved tuning member 196. Planar tuning member 194 extends between crown portion 182 and sole portion 190 on a toe side of club head 180. Curved tuning member 196 extends between crown portion 182 and sole portion 190 on a heel side of club head 180. The curvature and thickness of tuning members 194, 196 are selected so that club head has a desired vibration behavior. Preferably, the curvature of the curved tuning member is oriented so that it is curved away from the nearest side wall. For example, as shown, curved tuning member 196 is disposed on the heel side of club head 180 so it is oriented so that it is curved away from heel portion 184. It should be appreciated that the club head may be constructed using investment casting and the orientation of the curved tuning member may be selected to provide clearance for manipulating a core during the formation of the wax pattern, or model. In particular, in the present embodiment, by orienting the curved tuning member so it is curved away from the nearest side, additional clearance is provided for removing core pieces. As a result, removal of the core is simplified and fewer core pieces may be required. It should be appreciated that tuning members 194, 196 may be cast integral with club head 180 or formed separately and attached to club head 180.

Figure 20:
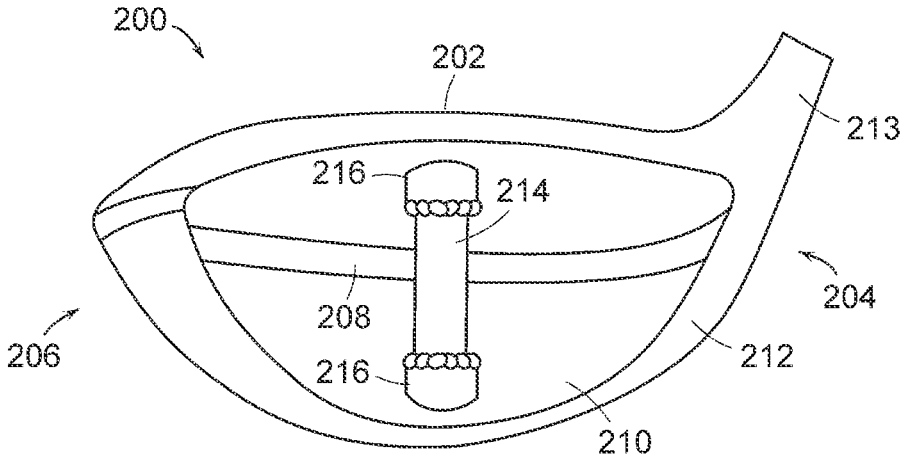
FIG. 20 is a front view of another embodiment of a golf club head in accordance with the present invention.
Figure 21:
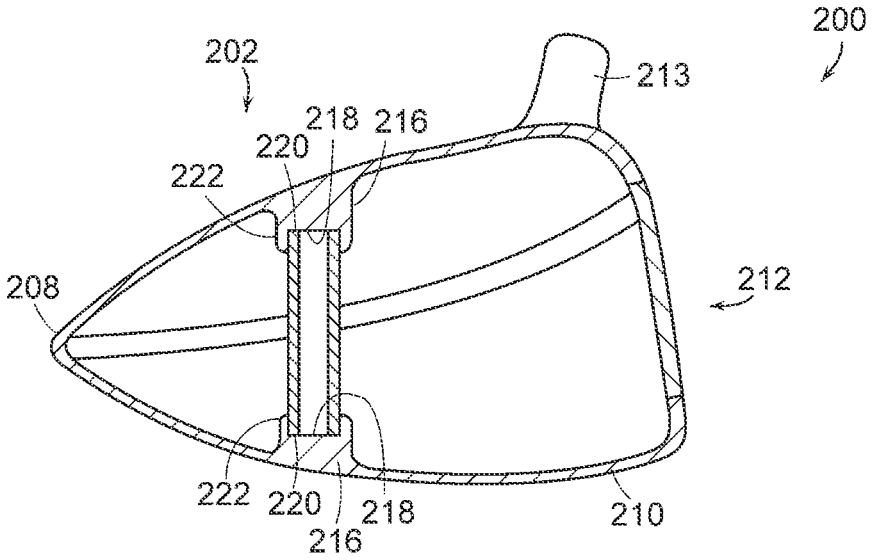
FIG. 21 is a cross-sectional view of the golf club head of FIG. 20.

Referring to FIGS. 20 and 21, another embodiment of a golf club head including a single tuning member will be described. Similar to previous embodiments, golf club head 200 is a hollow body constructed from a crown portion 202, a heel portion 204, a toe portion 206, a rear portion 208, a sole portion 210, a front portion 212 and a hosel 213. A single tuning member 214 extends between bosses 216 included on crown portion 202 and sole portion 210 and alters the vibration behavior of club head 200. In the present embodiment, the placement of tuning member 214 corresponds to a desired configuration for a club head having vibration characteristics such as exemplary club head 30 of FIG. 3. In particular, tuning member 214 is located so that it contacts crown portion 202 adjacent a location of maximum displacement of a low frequency vibration mode.

Bosses 216 provide attachment features for coupling tuning member 214 to crown portion 202 and sole portion 210. Bosses 216 are raised portions that extend inward from the inner surfaces of each of crown portion 202 and sole portion 210. Similar to the previously described embodiments, each boss 216 includes a mating surface 218 that is configured to abut an end surface 220 of tuning member 214 and a locating member 222 that aligns the end of tuning member 214 on boss 216 so that tuning member 214 is properly located for attachment.

Figure 12:
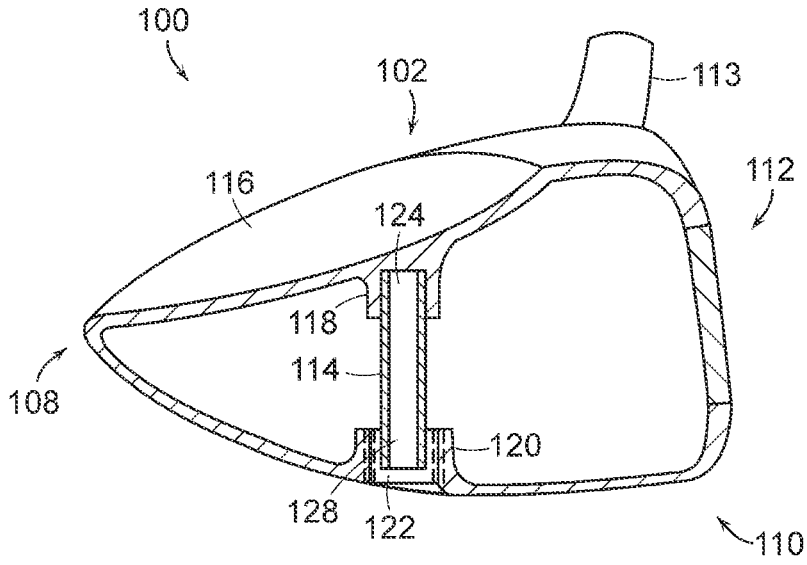
FIG. 12 is a cross-sectional view of the golf club head of FIG. 10, taken along line 12-12.
Figure 13:
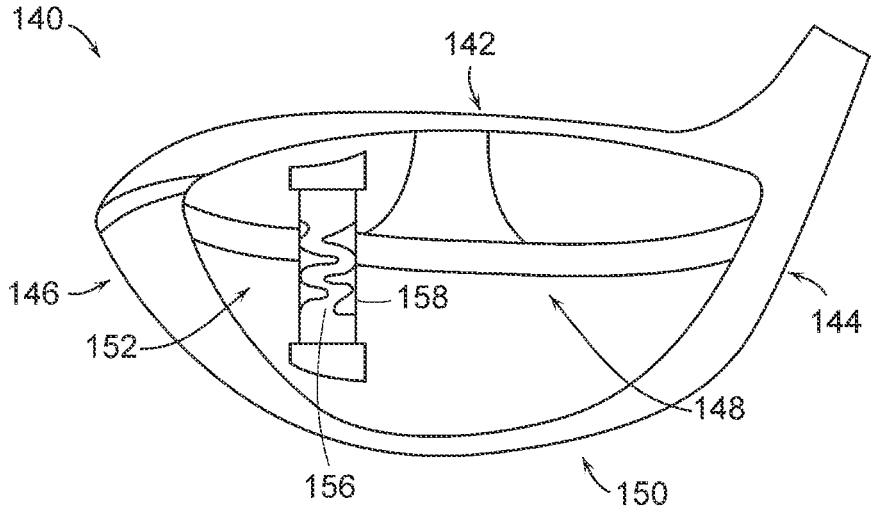
FIG. 13 is a front view of another embodiment of a golf club head in accordance with the present invention.
Figure 14:
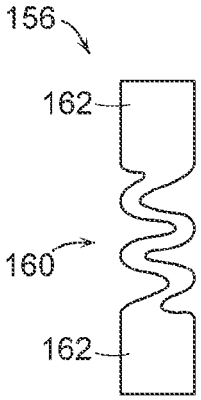
FIG. 14 is a side view of a spring element that may be included in a golf club head in accordance with the present invention.
Figure 15:
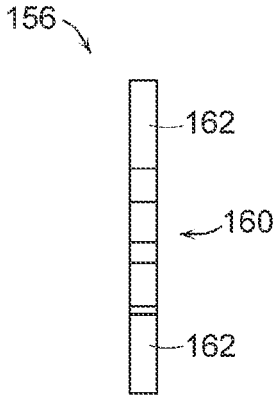
FIG. 15 is another side view of the spring element of FIG. 14.
Figure 16:
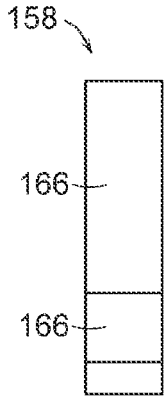
FIG. 16 is a side view of a dampening element that may be included in a golf club head in accordance with the present invention.
Figure 17:
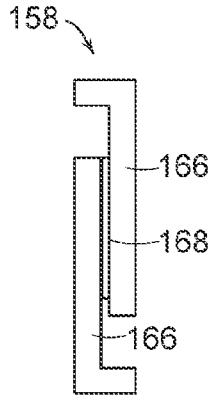
FIG. 17 is another side view of the dampening element of FIG. 16.

It should be appreciated that in any of the illustrated embodiments, bosses on the crown portion and/or the sole portion may be configured so that the tuning members may be removable, as shown in FIGS. 10-12. Removable tuning members allow a manufacturer or user to alter the sound tuning of a particular head. For example, a plurality of tuning members having different configurations may be provided and any combination of the tuning members may be installed in a club.

While it is apparent that the illustrative embodiments of the invention disclosed herein fulfill the objectives stated above, it is appreciated that numerous modifications and other embodiments may be devised by those skilled in the art. Elements from one embodiment can be incorporated into other embodiments. Therefore, it will be understood that the appended claims are intended to cover all such modifications and embodiments, which would come within the spirit and scope of the present invention.

What is claimed is:

1. A method of tuning a golf club head comprising:

providing a body including a crown portion and a sole portion, the body defining an interior cavity, wherein an aperture extends through the sole portion, the crown portion comprising a first attachment location within the interior cavity;

selecting one of a plurality of removable tuning members so as to change the sound tuning of a golf club head;

inserting the selected removable tuning member through the aperture and into the cavity such that the tuning member extends across the interior cavity and engages the crown portion at the first attachment location; and attaching a removable cover to the sole portion in the aperture, such that the tuning member is placed in a state of compression between the crown portion and the sole portion.

2. The method of claim 1, wherein the removable tuning member engages the cover.

3. The method of claim 1, wherein the first attachment location comprises a crown boss, and wherein the sole comprises an interior sole boss, and the selected removable tuning member engages both the crown and sole bosses.

4. The method of claim 3, wherein the aperture extends through the sole boss.

5. The method of claim 4, wherein the crown boss includes a mating surface that abuts an end surface of the tuning member.

6. The method of claim 1, wherein the selected removable tuning member comprises a spring member.

7. The method of claim 1, wherein the selected removable tuning member is constructed from both a metallic material and a non-metallic material.

8. The method of claim 7, wherein the non-metallic material is a viscoelastic polymer.

9. The method of claim 1, wherein the cover includes a threaded outer surface that threadably engages a threaded inner surface along the aperture.

10. The method of claim 1, wherein the cover comprises at least one tool engagement feature, and the method further comprises using a tool to remove the cover.

11. A golf club head, comprising:

a body including a crown portion and a sole portion and defining an interior cavity, wherein an aperture extends through the sole portion, the crown portion comprising a first attachment location within the interior cavity;

a cover removably coupled to the sole portion in the aperture, the cover including a tool engagement feature along an outer surface of the cover; and a removable tuning member selected from a plurality of tuning members for adjusting the sound tuning of the club head the selected removable tuning member extending across the interior cavity, wherein a first end of the tuning member is removably coupled to the crown portion at the first attachment location, and a second end of the tuning member is removably coupled to the cover.

12. The golf club head of claim 11, wherein the removable tuning member is in a state of compression between the first attachment location and the cover.

13. The golf club head of claim 11, wherein the first attachment location comprises a crown boss, and wherein the sole comprises an interior sole boss, and the selected removable tuning member engages both the crown and sole bosses.

14. The golf club of claim 13, wherein the aperture extends through the interior sole boss.

15. The golf club head of claim 11, wherein the crown boss includes a mating surface that is in abutment with an end surface of the tuning member.

16. The golf club head of claim 11, wherein the tuning member comprises a spring member.

17. The golf club head of claim 11, wherein the tuning member is constructed from both a metallic material and a non-metallic material.

18. The golf club head of claim 17, wherein the non-metallic material is a viscoelastic polymer.

19. The golf club head of claim 11, wherein the cover includes a threaded outer surface that is configured to threadably engage with a threaded inner surface along the aperture.

20. The golf club head of claim 11, wherein the selected removable tuning member comprises a plurality of lateral slots.

* * * * *